US012605027B2

(12) United States Patent
Wood

(10) Patent No.: US 12,605,027 B2
(45) Date of Patent: Apr. 21, 2026

(54) SQUEEGEE ASSEMBLY WITH IMPROVED WASTE PICK-UP

(71) Applicant: Nilfisk A/S, Broendby (DK)

(72) Inventor: David W. Wood, Delano, MN (US)

(73) Assignee: Nilfisk A/S, Broendby (DK)

( * ) Notice: Subject to any disclaimer, the term of this patent is extended or adjusted under 35 U.S.C. 154(b) by 962 days.

(21) Appl. No.: 17/788,165

(22) PCT Filed: Dec. 23, 2020

(86) PCT No.: PCT/DK2020/050406
§ 371 (c)(1),
(2) Date: Jun. 22, 2022

(87) PCT Pub. No.: WO2021/136572
PCT Pub. Date: Jul. 8, 2021

(65) Prior Publication Data

US 2023/0329510 A1 Oct. 19, 2023

Related U.S. Application Data

(60) Provisional application No. 62/955,234, filed on Dec. 30, 2019.

(51) Int. Cl.
*A47L 11/40* (2006.01)
*A47L 11/30* (2006.01)

(52) U.S. Cl.
CPC ..... *A47L 11/4044* (2013.01); *A47L 11/30* (2013.01)

(58) Field of Classification Search
CPC ..... A47L 11/4044; A47L 11/30
See application file for complete search history.

(56) References Cited

U.S. PATENT DOCUMENTS

| | | | |
|---|---|---|---|
| 6,047,437 | A | 4/2000 | Suzuki |
| 6,397,429 | B1 | 6/2002 | Legatt et al. |
| 6,519,808 | B2 | 2/2003 | Legatt et al. |
| 6,557,207 | B2 | 5/2003 | Stuchlik |
| 6,895,633 | B2 | 5/2005 | Tucker |
| 7,254,867 | B2 | 8/2007 | Legatt et al. |

(Continued)

FOREIGN PATENT DOCUMENTS

WO 2016073163 A1 5/2016

OTHER PUBLICATIONS

International Search Report and Written Opinion from PCT Application Serial No. PCT/DK2020/050406, dated Mar. 12, 2021, 10 pages.

*Primary Examiner* — Andrew A Horton
(74) *Attorney, Agent, or Firm* — Dicke, Billig & Czaja, PLLC

(57) ABSTRACT

A squeegee assembly includes a front blade, a rear blade, and a support for mounting the blades. The front blade includes an outer surface, an inner surface, and a floor engaging edge. The rear blade includes an outer surface, an inner surface facing the inner surface of the front blade, and a wiping edge. The support includes a vacuum source port and a suction port. The rear blade has a curvature between opposing first and second ends of the rear blade that defines at least one rearmost point. At least the suction port is offset from a line of the support that extends through the at least one rearmost point parallel to a forward direction of travel of the squeegee assembly.

18 Claims, 16 Drawing Sheets

(56) References Cited

U.S. PATENT DOCUMENTS

| | | | | |
|---|---|---|---|---|
| 9,038,237 | B2 | 5/2015 | Wood | |
| 2003/0233729 | A1 | 12/2003 | Tucker | |
| 2016/0120385 | A1* | 5/2016 | Nortrup | A47L 11/4077 15/320 |

* cited by examiner

SQUEEGEE ASSEMBLY WITH IMPROVED WASTE PICK-UP

CROSS-REFERENCE TO RELATED APPLICATION(S)

This application is a Section 371 National Stage Application of International Application No. PCT/DK2020/050406, filed Dec. 23, 2020, entitled "SQUEEGEE ASSEMBLY WITH IMPROVED WASTE PICK-UP", which claims benefit of U.S. Provisional Application No. 62/955,234, filed Dec. 30, 2019, incorporated herein by reference in their entirety.

FIELD

The present disclosure relates generally to a cleaning apparatus. More specifically, the present disclosure relates to a vacuumized squeegee assembly structured for attachment to a floor cleaning system and having improved pick-up capabilities.

BACKGROUND

The use of vacuumized squeegee assemblies for wiping a surface and collecting dirty solution is conventional in many applications including, but not limited to, floor surface cleaning machines such as floor scrubbers. Typically, the front and rear blades of the squeegee assembly are always in contact with the floor surface so that any liquid on the floor surface is exposed to, picked up, and carried by airflow in the squeegee assembly. The rear blade in particular is provided with sufficient downward force to bend the blade outward so that only one edge of the blade engages the floor surface. Exemplary squeegee assemblies incorporating front and rear blades are disclosed in U.S. Pat. Nos. 7,254,867 and 6,557,207.

The surface qualities of the floor are an important factor in the ability of the squeegee assembly to function as desired. As appreciated by those skilled in the art, squeegee assemblies function ideally with a level, smooth floor surface.

However, floor surfaces are of a variety of types which are not always level and/or completely smooth such as by design as in the case of grouted tile or textured floors, by necessity or damage such as in the case of seams and/or cracks, or by wear such as rough or pitted surfaces. In those instances, moisture may be located in depressions which may be easily passed over by the blades and/or not exposed to airflow sufficient to be picked up thereby.

FIG. 1 is a diagram illustrating one example of a conventional squeegee assembly. In particular, FIG. 1 illustrates a cross-section of a conventional squeegee assembly 10, which generally includes a support 12, a suction tube 14 structured for connection to a vacuum source, a front flexible blade 16, and a rear flexible blade 18. The front flexible blade 16 and rear flexible blade 18 are spaced apart and attached to an inside surface of the support 12 at respective front and rear portions thereof. As illustrated in FIG. 1, the front flexible blade 16 and rear flexible blade 18 of the squeegee assembly 10 are in contact with a floor surface F comprising a plurality of tiles T separated by grout lines G.

During operation of the conventional squeegee assembly 10, when the front flexible blade 16 and rear flexible blade 18 pass over the grout line G, air may be taken through the grout line. Such air passing between the rear wiping blade and the grout line channel may assist in removing water from the grout lines or cracks by entraining liquid in the grout line in the rapidly moving air.

However, in some conventional squeegee assemblies, dirty liquid may pool against a portion of the rear flexible blade adjacent the suction tube due to the flow dynamics within the suction chamber formed between the front and rear flexible blades. This phenomenon is illustrated in FIG. 2A, which is a bottom view of the squeegee assembly 10 showing a pool of liquid P built-up against rear flexible blade 18 adjacent the suction tube 14. In particular, the majority of the liquid is suctioned through the suction tube 14 as indicated by the broken lines between the front flexible blade 16 and rear flexible blade 18 that are directed toward the suction tube. However, a portion of the liquid is not suctioned through the suction tube 14, and instead builds-up and forms the pool of liquid P near the center of the rear flexible blade 18. Thereafter, when the rear flexible blade 18 passes over a grout line, crack, or other irregularity in the floor, a gap is formed between the rear flexible blade 18 and the floor surface allowing the pooled dirty liquid P to pass through the gap and splash in a rearward direction leaving behind a puddle on the floor. Such puddles are not only aesthetically displeasing, but they also create safety hazards for individuals who must walk across the floor after the floor has been cleaned.

More particularly, liquid is directed by the curvature of the blades and by the air moving in the direction of the suction tube toward the rearmost portion of the squeegee assembly where it is carried up into a recovery tank. Both air and entrained liquid move along the rear blade and into the suction tube opening during operation of the squeegee assembly. However, as illustrated in FIG. 2B, there is a region of very low air flow near the suction tube 14 where the air stream L from the left side of the suction tube 14 comes together with the air stream R from the right side of the suction tube 14. A significant amount of liquid may be collected in this region, thus creating the pool of liquid P. Consequently, and as depicted in the diagram of the rear flexible blade 18 in FIG. 2C, when the rearmost portion of the rear flexible blade 18 approaches the grout line G (or other surface irregularity), this pool of liquid P will spread into the grout line. After the squeegee assembly passes over the grout line G, this liquid may be expelled from the grout line G due in part to the action of the rear flexible blade 18 slapping the water out as it passes over the grout line.

Several attempts have been made to address the above shortcomings. One attempt has been to increase the strength of the vacuum pump coupled to the suction tube. However, this solution has proved costly and is not ideal due to the increased power demands. Moreover, increasing the strength of the vacuum pump does not eliminate the area of low air flow near the vacuum port. A second attempt has been to increase the suctioning force of dirty liquid by reducing the space between the front and rear flexible blades. However, this solution has not been successful because reducing the space between the front and rear flexible blades limits the width of the suction port, which in turn necessitates an extreme transition from a narrow-slotted vacuum port to a round vacuum hose. Such a severe transition adds height to the squeegee assembly and may become easily clogged with debris. As a result, it is almost impossible to suction all of the dirty liquid from grout lines and cracks effectively with a conventional vacuumized squeegee. A third attempt has been to add holes in the rear squeegee blade as described in U.S. Pat. No. 9,038,237. However, the presence of such holes results in a much noisier cleaning operation. Furthermore, as the rear blade wears over time and the bottom edge of the blade approaches the holes, the blade can leave streaks on the floor which is undesirable.

Another shortcoming of conventional squeegee assemblies is the presence of backflow liquid when the vacuum pump is turned off upon completion of a cleaning task. Specifically, when the vacuum pump is disabled and the flow of air through the suction tube 14 is halted, liquid that has collected on the inner surfaces of the suction tube 14 will tend to flow back down the suction tube 14 and create a small puddle on the floor surface beneath the squeegee assembly.

Thus, there is a need for a squeegee assembly having improved pick-up capabilities. There is a further need for a squeegee assembly that is designed to minimize the pooling of liquid against the rear blade of the assembly.

SUMMARY

A squeegee assembly for wiping a surface to be cleaned includes a front blade, a rear blade, and a support. The front blade includes an outer surface, an inner surface, and a floor engaging edge. The rear blade includes an outer surface, an inner surface facing the inner surface of the front blade, and a wiping edge. The front blade and rear blade are mounted to the support, which includes a vacuum source port and a suction port. The rear blade has a curvature between opposing first and second ends of the rear blade. The curvature of the rear blade defines at least one rearmost point. At least the suction port is offset from a first line of the support that extends through the at least one rearmost point of the rear blade parallel to a forward direction of travel of the squeegee assembly.

A cleaning machine for use in cleaning a surface includes a squeegee assembly, a chassis, a plurality of wheels, and a scrubber assembly. The squeegee assembly includes a front blade, a rear blade, and a support. The front blade includes an outer surface, an inner surface, and a floor engaging edge. The rear blade includes an outer surface, an inner surface facing the inner surface of the front blade, and a wiping edge. The front blade and rear blade are mounted to the support, which includes a vacuum source port and a suction port. The rear blade has a curvature between opposing first and second ends of the rear blade. The curvature of the rear blade defines at least one rearmost point. At least the suction port is offset from a first line of the support that extends through the at least one rearmost point of the rear blade parallel to a forward direction of travel of the squeegee assembly. The chassis has a leading portion and a trailing portion and is positioned at a portion of the chassis. The plurality of wheels is associated with the chassis, with at least one of the wheels being pivotal for steering the cleaning machine. The scrubber assembly is operable to scrub a floor and is operable to apply a liquid to a floor.

BRIEF DESCRIPTION OF THE DRAWINGS

The disclosure will now be described in more detail with regard to the accompanying FIGS. The FIGS. show one way of implementing the present disclosure and is not to be construed as being limiting to other possible embodiments falling within the scope of the attached claim set.

In the drawings, which are not necessarily drawn to scale, like numerals may describe similar components in different views. Like numerals having different letter suffixes may represent different instances of similar components.

DETAILED DESCRIPTION

Figure 1:
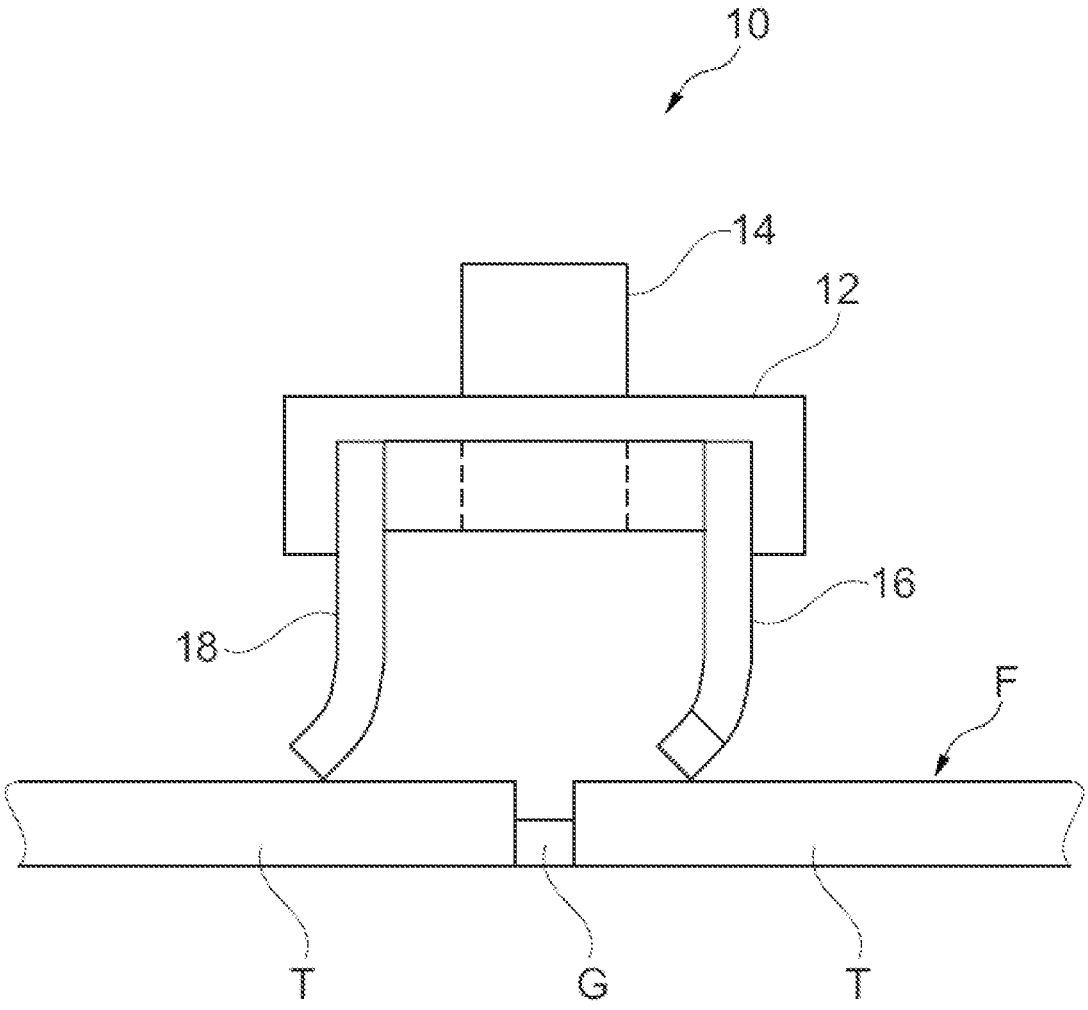
Fig. 1 PRIOR ART
FIG. 1 is a diagram illustrating one example of a conventional squeegee assembly.
Figure 2A:
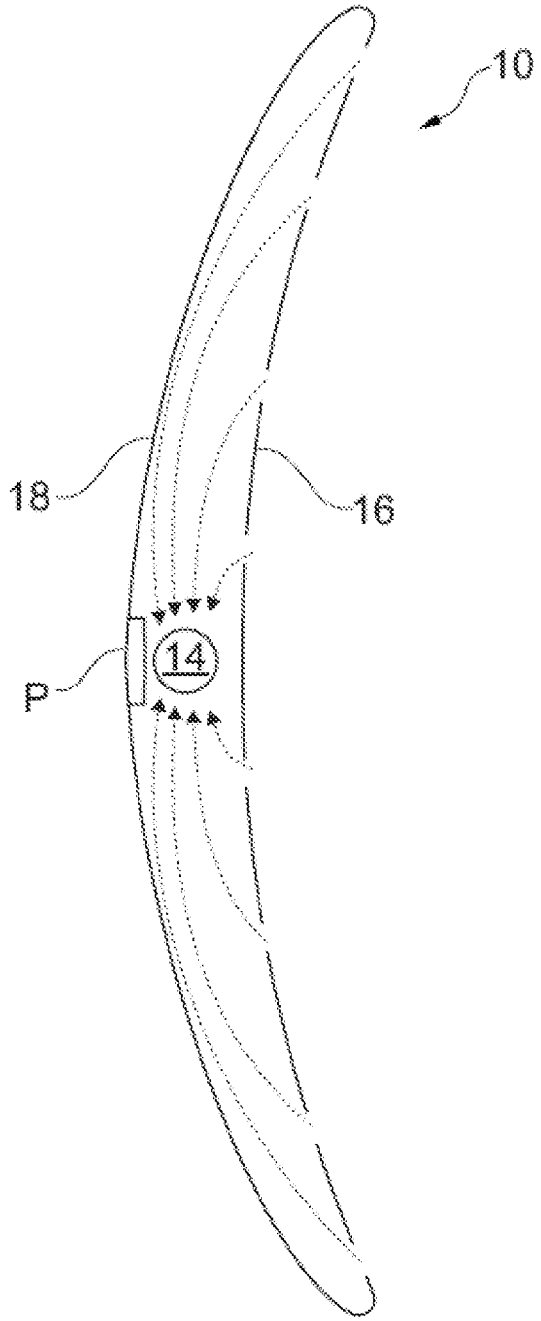
Fig. 2A PRIOR ART
FIGS. 2A-2C illustrate various diagrams of the conventional squeegee assembly of FIG. 1 showing a pool of liquid built-up against a rear flexible blade of the squeegee assembly.
Figure 2B:
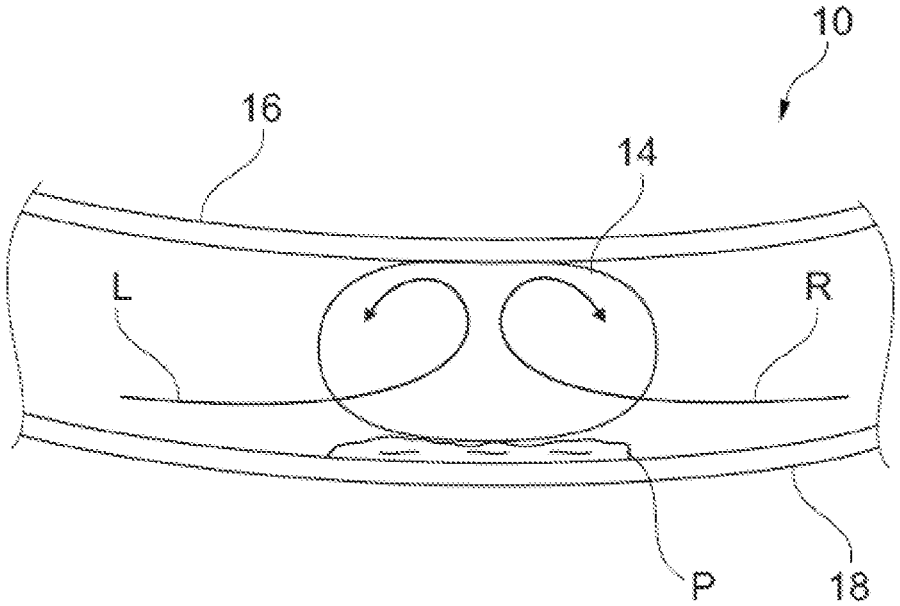
Fig. 2B PRIOR ART
Figure 2C:
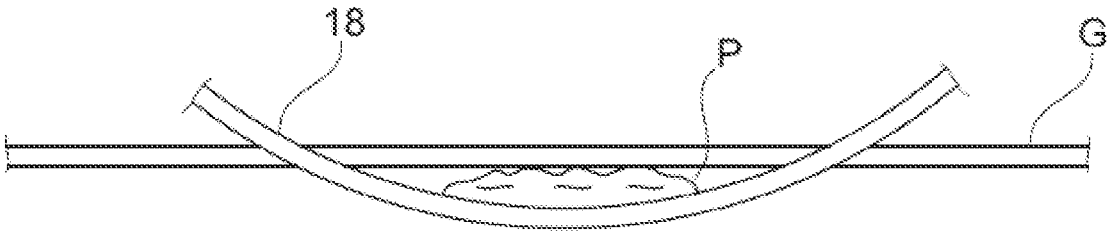
Fig. 2C PRIOR ART

In view of the above, it may be seen as an object of the present invention to provide a squeegee assembly with a minimized pooling of liquid against the rear blade of the assembly. Preferably, the squeegee assembly further has a minimized backflow or liquid upon stopping of the connected vacuum pump.

The invention provides in a first aspect, a squeegee assembly for wiping a surface to be cleaned comprising:

a front blade including an outer surface, an inner surface, and a floor engaging edge;

a rear blade including an outer surface, an inner surface facing the inner surface of the front blade, and a wiping edge; and a support upon which the front and rear blades are mounted, the support including a vacuum source port and a suction port;

wherein the rear blade has a curvature between opposing first and second ends of the rear blade, the curvature of the rear blade defining at least one rearmost point; and wherein at least the suction port is offset from a line of the support that extends through the at least one rearmost point parallel to a forward direction of travel of the squeegee assembly.

In general said line of the support may be a centerline of the support to be understood as a line through a midpoint, or substantially a midpoint, between the first and second ends of the rear blade, or it may be a line different from the centerline in case the rear blade is asymmetrical. Especially, the line of the support may be a line that extends through the at least one rearmost point of the rear blade parallel to a forward direction of travel of the squeegee assembly.

Especially, the suction port may be offset from said line of the support in a direction towards either the first end or the second end of the rear blade.

Such squeegee assembly is advantageous e.g. for use on a floor cleaning machine to wipe liquid from a liquid cleaned floor, either a manual, semi-automatic of fully automatic floor cleaning machine, since wiping performance is improved compared to prior art designs.

The offset of the suction port from a line of the support has been found to minimize the pooling of liquid against the rear blade due to an improved flow in the space between the front and rear blades. This means that the squeegee assembly will have an improved wiping performance also on floors with grout lines. This is achieved without the need to increase the power of the vacuum pump.

Further, it is possible to provide a squeegee assembly design with an intermediate chamber between the suction port and the vacuum source port which minimizes the backflow of liquid when the vacuum pump is stopped. This further helps to increase wiping performance without the need to re-wipe an already wiped area in case the vacuum pump stops by accident or cleaning machine.

Features and embodiments of the disclosure are described herein.

By a 'bottom surface of the support' is understood as an underside of the support, i.e. the surface of the support facing towards the surface to be cleaned, when the squeegee is in a normal cleaning operation.

By 'suction port' is to be understood as a port or opening arranged for suction of liquid in the suction chamber formed between the front and rear blades.

By 'source port' is to be understood as a port or opening arranged for connection to a source of vacuum or suction, e.g. via a pipe or hose.

By 'vertically aligned' is to be understood as aligned along a line which is perpendicular to the surface to be cleaned, when the squeegee assembly is in a normal position for cleaning the surface. Such surface may e.g. be a horizontal plane floor.

In an embodiment, the front and rear blades are spaced apart by a maximum distance along the line of the support. Especially, a center of the vacuum source port may be vertically aligned with a center of the suction port.

An outer edge of the suction port may be offset from the line of the support by a distance equal to or greater than one-half of the maximum distance between the front and rear blades.

A center of the suction port may be offset from the line of the support by a distance equal to or greater than one-half of a length defined between the line of the support and the first end of the rear blade. Here, the term 'center of the suction port' may be understood as a geometric center of the suction port.

Especially, the center of the suction port may be offset from the line of the support by a distance equal to or less than two-thirds of the length defined between the line of the support and the first end of the rear blade. More specifically, the centers of the vacuum source port and the suction port may be offset from the line of the support by a distance equal to or less than two-thirds of the length defined between the line of the support and the first end of the read blade.

In some embodiments, the suction port is offset from the vacuum source port, the suction port located on a bottom surface of the support;

a suction chamber is formed between the front blade, the rear blade, and the bottom surface of the support; and an intermediate chamber formed between the suction port and the vacuum source port.

This intermediate chamber serves to reduce backflow when vacuum is removed from the vacuum source port, e.g. when a connected vacuum pump is stopped. Especially, the intermediate chamber may be formed above the suction chamber. Especially, the intermediate chamber may be defined by inner wall surfaces of the support and a base surface. This can be used to provide a compact support design yet housing the intermediate chamber. Especially, the vacuum source port is structured to be coupled to a vacuum source such that, in use, an airflow path can be generated from the suction chamber, through the intermediate chamber, and toward the vacuum source port. Specifically, at least a part of the base surface of the intermediate chamber may be arranged below the bottom surface of the support.

Especially, the front and rear blades may be spaced apart by a maximum distance along a line of the support, such as a centerline, of the support that extends through the rear apex parallel to a forward direction of travel of the squeegee assembly, wherein a center of the vacuum source port, such as a geometric center of the vacuum source port, is disposed along the line of the support, and wherein a center of the suction port, such as a geometric center of the suction port, is disposed along the line of the support and is offset from the center of the vacuum source port in a forward direction. Especially, the front and rear blades may be spaced apart by a maximum distance along a line of the support that extends through the rear apex parallel to a forward direction of travel of the squeegee assembly, wherein a center of the vacuum source port is disposed along the line of the support, and wherein a center of the suction port is offset from the line of the support in a lateral direction. Especially, the center of the suction port may further be offset from the center of the vacuum source port in a forward direction. Especially, an outer edge of the suction port may be offset from the line of the support by a distance equal to or greater than one-half of the maximum distance between the front and rear blades. Especially, a center of the suction port may be offset from the line of the support by a distance equal to or greater than one-half of a length defined between the line of the support and the first end of the rear blade. More specifically, the center of the suction port may be offset from the line of the support by a distance equal to or less than two-thirds of the length defined between the line of the support and the first end of the rear blade.

In some embodiments, a center of the suction port is laterally offset from a center of the vacuum source port. Especially, the suction port may be laterally offset from the vacuum source port by an offset distance, wherein the offset distance is equal to or greater than a diameter of the vacuum source port. Especially, the intermediate chamber may include a contoured base surface spaced vertically below the vacuum source port, the contoured base surface forming a water trap configured to collect backflow liquid from the vacuum source port. Specifically, the intermediate chamber may include a planar sidewall, and wherein the contoured base surface is defined by at least one curved portion spaced vertically below the planar sidewall. Especially, the center of the vacuum source port may be disposed along a line of the support that extends between a front apex of the front blade and a rear apex of the rear blade. Specifically, the center of the suction port may further be offset from the center of the vacuum source port in a forward direction.

To better illustrate the systems and methods disclosed herein, a non-limiting list of examples is provided here:

In Example 1, a squeegee assembly for wiping a surface to be cleaned can be provided that includes: a front blade including an outer surface, an inner surface, and a floor engaging edge; a rear blade including an outer surface, an inner surface facing the inner surface of the front blade, and a wiping edge; and a support upon which the front and rear blades are mounted, the support including a vacuum source port and a suction port; wherein the rear blade has a curvature between opposing first and second ends of the rear blade, the curvature of the rear blade defining at least one rearmost point; and wherein at least the suction port is offset from a centerline of the support that extends through the at least one rearmost point parallel to a forward direction of travel of the squeegee assembly.

In Example 2, the squeegee assembly of Example 1 can optionally be configured such that the front and rear blades are spaced apart by a maximum distance along the centerline of the support.

In Example 3, the squeegee assembly of Example 1 or Example 2 can optionally be configured such that a center of the vacuum source port is vertically aligned with a center of the suction port.

In Example 4, the squeegee assembly of any one or any combination of Examples 1-3 can optionally be configured such that an outer edge of the suction port is offset from the centerline by a distance equal to or greater than one-half of the maximum distance between the front and rear blades.

In Example 5, the squeegee assembly of any one or any combination of Examples 1-3 can optionally be configured such that a center of the suction port is offset from the centerline by a distance equal to or greater than one-half of a length defined between the centerline and the first end of the rear blade.

In Example 6, the squeegee assembly of Example 5 can optionally be configured such that the centers of the vacuum source port and suction port are offset from the centerline by a distance equal to or less than two-thirds of the length defined between the centerline and the first end of the rear blade.

In Example 7, a squeegee assembly for wiping a surface to be cleaned can be provided that includes: a front blade including an outer surface, an inner surface, and a floor engaging edge; a rear blade including an outer surface, an inner surface facing the inner surface of the front blade, and a wiping edge; and a support upon which the front and rear blades are mounted, the support including: a vacuum source port; a suction port offset from the vacuum source port, the suction port located on a bottom surface of the support; a suction chamber formed between the front blade, the rear blade, and the bottom surface of the support; and an intermediate chamber formed above the suction chamber and between the suction port and the vacuum source port, the intermediate chamber defined by inner wall surfaces of the support; wherein the rear blade has a curvature between opposing first and second ends of the blade, the curvature of the rear blade defining a rear apex.

In Example 8, the squeegee assembly of Example 7 can optionally be configured such that the vacuum source port is structured to be coupled to a vacuum source such that, in use, an airflow path can be generated from the suction chamber, through the intermediate chamber, and toward the vacuum source port.

In Example 9, the squeegee assembly of Example 7 or Example 8 can optionally be configured such that the front and rear blades are spaced apart by a maximum distance along a centerline of the support that extends through the rear apex parallel to a forward direction of travel of the squeegee assembly, wherein a center of the vacuum source port is disposed along the centerline of the support, and wherein a center of the suction port is disposed along the centerline of the support and is offset from the center of the vacuum source port in a forward direction.

In Example 10, the squeegee assembly of Example 7 or Example 8 can optionally be configured such that the front and rear blades are spaced apart by a maximum distance along a centerline of the support that extends through the rear apex parallel to a forward direction of travel of the squeegee assembly, wherein a center of the vacuum source port is disposed along the centerline of the support, and wherein a center of the suction port is offset from the centerline of the support in a lateral direction.

In Example 11, the squeegee assembly of Example 10 can optionally be configured such that the center of the suction port is further offset from the center of the vacuum source port in a forward direction.

In Example 12, the squeegee assembly of Example 10 or Example 11 can optionally be configured such that an outer edge of the suction port is offset from the centerline by a distance equal to or greater than one-half of the maximum distance between the front and rear blades.

In Example 13, the squeegee assembly of any one or any combination of Examples 10-12 can optionally be configured such that a center of the suction port is offset from the centerline by a distance equal to or greater than one-half of a length defined between the centerline and the first end of the rear blade.

In Example 14, the squeegee assembly of Example 13 can optionally be configured such that the center of the suction port is offset from the centerline by a distance equal to or less than two-thirds of the length defined between the centerline and the first end of the rear blade.

In Example 15, a squeegee assembly for wiping a surface to be cleaned can be provided that includes: a front blade including an outer surface, an inner surface, and a floor engaging edge; a rear blade including an outer surface, an inner surface facing the inner surface of the front blade, and a wiping edge; and a support upon which the front and rear blades are mounted in a curved configuration, the support including a vacuum source port, a suction port, a suction chamber defined between the front blade and the rear blade, and an intermediate chamber defined between the suction port and the vacuum source port; wherein a center of the suction port is laterally offset from a center of the vacuum source port.

In Example 16, the squeegee assembly of Example 15 can optionally be configured such that the suction port is laterally offset from the vacuum source port by an offset distance, wherein the offset distance is equal to or greater than a diameter of the vacuum source port.

In Example 17, the squeegee assembly of Example 15 or Example 16 can optionally be configured such that the intermediate chamber includes a contoured base surface spaced vertically below the vacuum source port, the contoured base surface forming a water trap configured to collect backflow liquid from the vacuum source port.

In Example 18, the squeegee assembly of Example 17 can optionally be configured such that the intermediate chamber includes a planar sidewall, and wherein the contoured base surface is defined by at least one curved portion spaced vertically below the planar sidewall.

In Example 19, the squeegee assembly of any one or any combination of Examples 15-18 can optionally be configured such that the center of the vacuum source port is disposed along a centerline of the support that extends between a front apex of the front blade and a rear apex of the rear blade.

In Example 20, the squeegee assembly of Example 19 can optionally be configured such that the center of the suction port is further offset from the center of the vacuum source port in a forward direction.

In Example 21, the squeegee assembly of any one or any combination of Examples 1-20 is optionally configured such that all elements or options recited are available to use or select from.

In a second aspect, the disclosure provides a cleaning machine for use in cleaning a surface, comprising the squeegee assembly according to the first aspect.

Especially, the cleaning machine may comprise a chassis having a leading portion and a trailing portion, wherein the squeegee assembly is positioned at a portion of the chassis, such as at a trailing portion of the chassis or at a middle portion of the chassis, such as the squeegee assembly being positioned at a portion of 30-70% of a total length of the chassis from a front of the chassis, such as 40-60% of a total length of the chassis from a front of the chassis;

a plurality of wheels associated with the chassis, at least one of the wheels being pivotal for steering the cleaning machine; and a scrubber assembly operable to scrub a floor, said scrubber assembly positioned at the leading portion, said scrubber assembly being operable to apply a liquid to a floor.

In a third aspect, the disclosure provides a method of cleaning a floor, the method comprising providing the squeegee assembly according to the first aspect, applying a liquid to the floor, and wiping the floor by means of the squeegee assembly.

The advantages described for the first aspect apply as well for the second and third aspects. The individual aspects of the present disclosure may each be combined with any of the other aspects. These and other aspects of the disclosure will be apparent from the following description with reference to the described embodiments.

DETAILED DESCRIPTION

In FIGS. 1-4B, and 6A-9B, the squeegee assembly embodiments shown are all symmetric, and thus the line of the support 26 shown is a centerline between a point of the front flexible blade 22 substantially in the middle of the first end and the second end of the front flexible blade 22 and a point of the rear flexible blade 24 substantially in the middle of the first end and the second end of the rear flexible blade 24. However, the line of the support 26 might not be a centerline, since the front flexible blade 22 and/or the rear flexible blade 24 may be somewhat asymmetrical. This can be seen in FIGS. 5A-5E, where the right end is farther forward (relative to the direction of travel) than the left end. Thus, the rearmost point of the rear blade is not equidistant from the two ends, and a line through that point and parallel to the direction of travel does not intersect the center point of the arc shaped front and rear blades, thus making it asymmetrical. In this case, the line of the support 26 extending through the at least one rearmost point of the rear blade and being parallel to a forward direction of travel F of the squeegee assembly 20 will not be a centerline of the support 26, but it will rather be a line closer to the first or second end of the rear flexible blade 24.

Figure 3A:
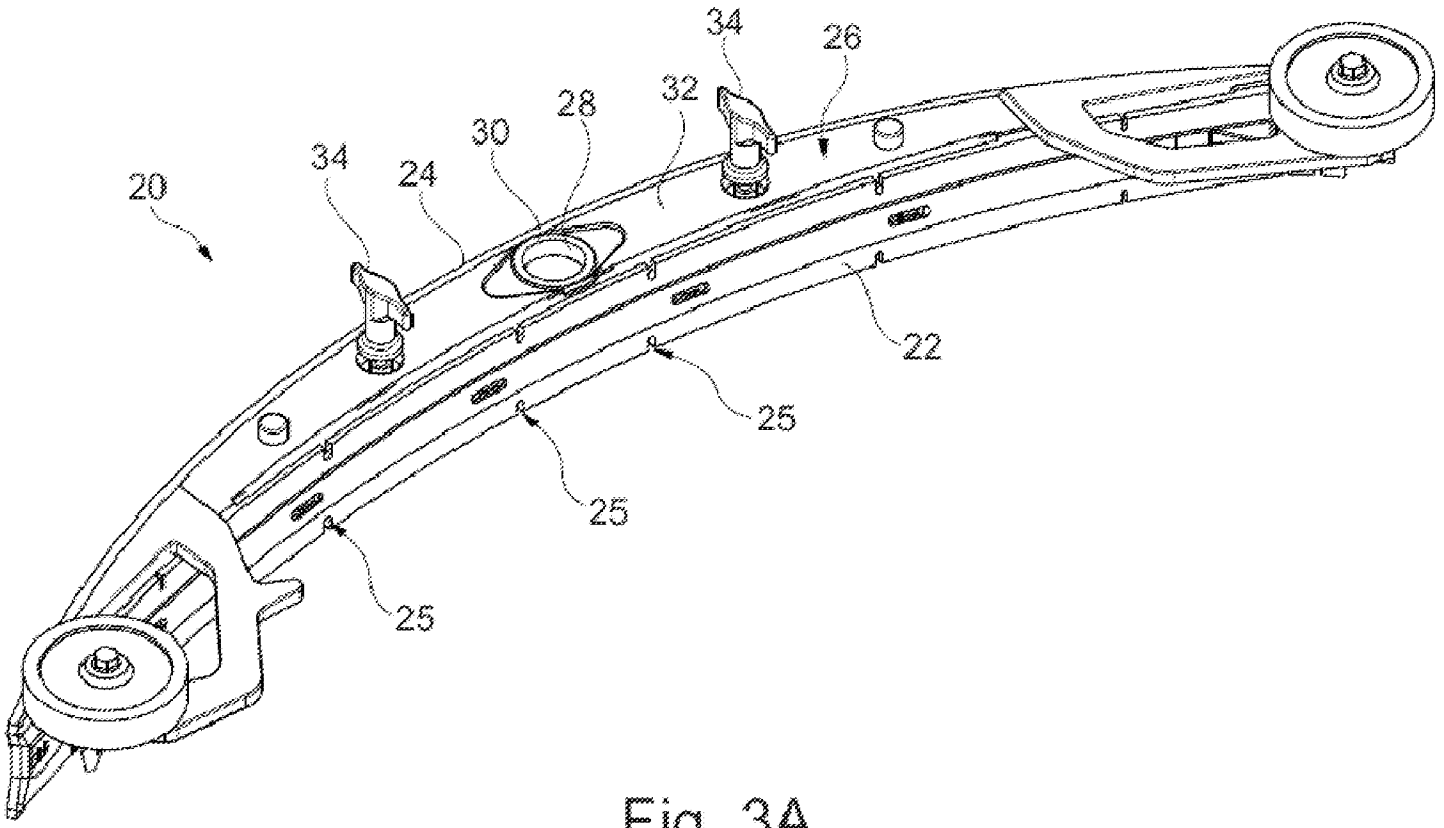
FIG. 3A is a front perspective view of a squeegee assembly in accordance with at least one example of the present disclosure.
Figure 3B:
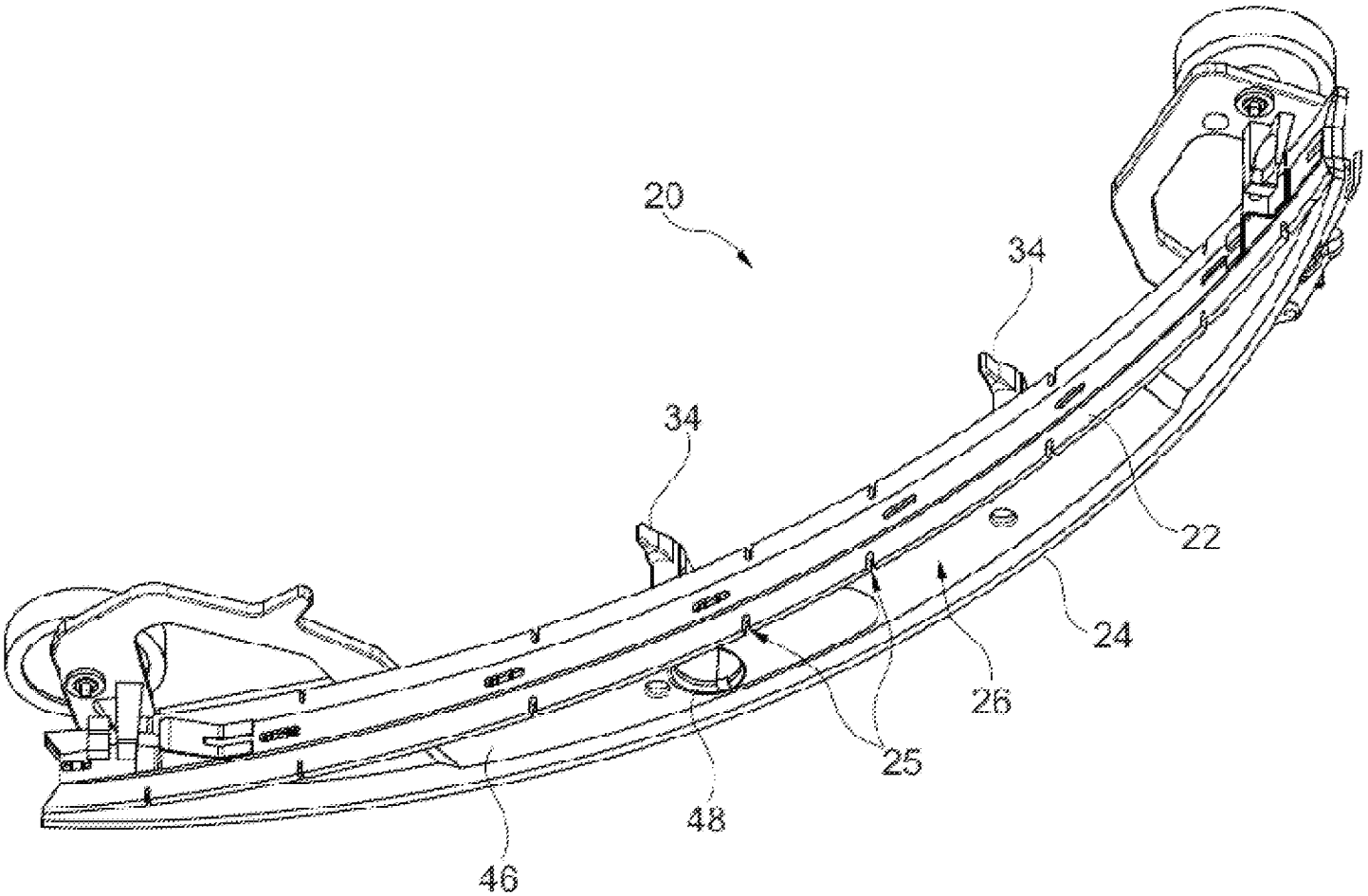
FIG. 3B is another front perspective view of the squeegee assembly of FIG. 3A in accordance with at least one example of the present disclosure.

The present patent application relates to an improved squeegee assembly for wiping a surface and collecting a liquid through vacuum pickup. FIGS. 3A and 3B are front perspective views of a squeegee assembly 20 in accordance with at least one example of the present disclosure. As illustrated in FIGS. 3A and 3B, the squeegee assembly 20 can include a front flexible blade 22, a rear flexible blade 24, a support 26, and a vacuum source port 28 structured for connection to a vacuum source. Although the front flexible blade 22 and the rear flexible blade 24 are described as "flexible," squeegee assemblies that are within the intended scope of the present disclosure do not have to include flexible blades. In some examples, at least one of the front flexible blade 22 or the rear flexible blade 24 can be non-flexible, rigid, semi-rigid, or the like.

The front flexible blade 22 and rear flexible blade 24 can extend from a bottom side of the support 26 and can be structured and designed to contact a floor surface. As illustrated in FIG. 3A, an upper end 30 of the vacuum source port 28 can extend from a top side 32 of the support 26. As illustrated in FIG. 3B, a suction port 48 is provided on a bottom side 46 of the support 26. An intermediate chamber can be formed within the support 26 between the suction port 48 and the vacuum source port 28 as will be discussed in further detail below.

With further reference to FIGS. 3A and 3B, one or more connection members 34 for connecting the squeegee assembly 20 to a surface cleaning machine can also extend from the top side 32 of the support 26. Any suitable connection member can be used without departing from the intended scope of the present disclosure.

As will be appreciated by those skilled in the art, the squeegee assembly 20 can be utilized with any surface cleaning machine that incorporates the use of a vacuumized squeegee assembly for retrieving a liquid applied to a surface.

Exemplary, but non-limiting floor surface cleaning machines that can utilize a squeegee assembly in accordance with the present disclosure are disclosed in U.S. Pat. Nos. 6,397,429 and 6,519,808, which are incorporated by reference herein in their entireties.

In operation, the squeegee assembly 20 can be coupled to a surface cleaning machine such that the front flexible blade 22 is oriented with respect to the forward movement of the surface cleaning machine. A vacuum can be supplied through the vacuum source port 28 such that air and solution can be pulled into the squeegee assembly 20. The vacuum source port 28 can further be in fluid communication with a recovery tank, which in turn can be in fluid communication with a vacuum assembly operable to draw air from the hollow interior of the recovery tank.

As illustrated in FIGS. 3A and 3B, the front flexible blade 22 and rear flexible blade 24 can be designed such that they are curved when attached to the support 26. Due to the curved configuration, solution tends to pass through one or more openings or slots 25 in the front flexible blade 22 or underneath the front flexible blade 22 and is not directed to travel past the ends of the squeegee assembly. The rear flexible blade 24 can be structured to function as a "wiper" to leave the floor surface substantially dry after liquid has been suctioned therefrom.

As will be appreciated by those skilled in the art, the front flexible blade 22 and rear flexible blade 24 of the squeegee assembly 20 are illustrated in FIGS. 3A and 3B as having a curved configuration merely for purposes of example and not limitation. Thus, it should be appreciated that the teachings of the present disclosure can have application to other types of squeegee configurations, including but not limited to a straight-blade configuration and a curved configuration that is different from the configuration depicted in FIGS. 3A and 3B. Furthermore, the front flexible blade 22 and rear flexible blade 24 can be formed from any suitable material as will be appreciated by those skilled in the art. Exemplary blade materials can include, but are not limited to, gum rubber, neoprene, urethane, and the like. As mentioned above the front flexible blade 22 and/or the rear flexible blade 24 can be non-flexible, rigid, semi-rigid, or the like. In an example, the front flexible blade 22 can be a bristle strip that is configured to allow controlled amounts of air and water (or solution) to pass through the bristles.

Figure 4A:
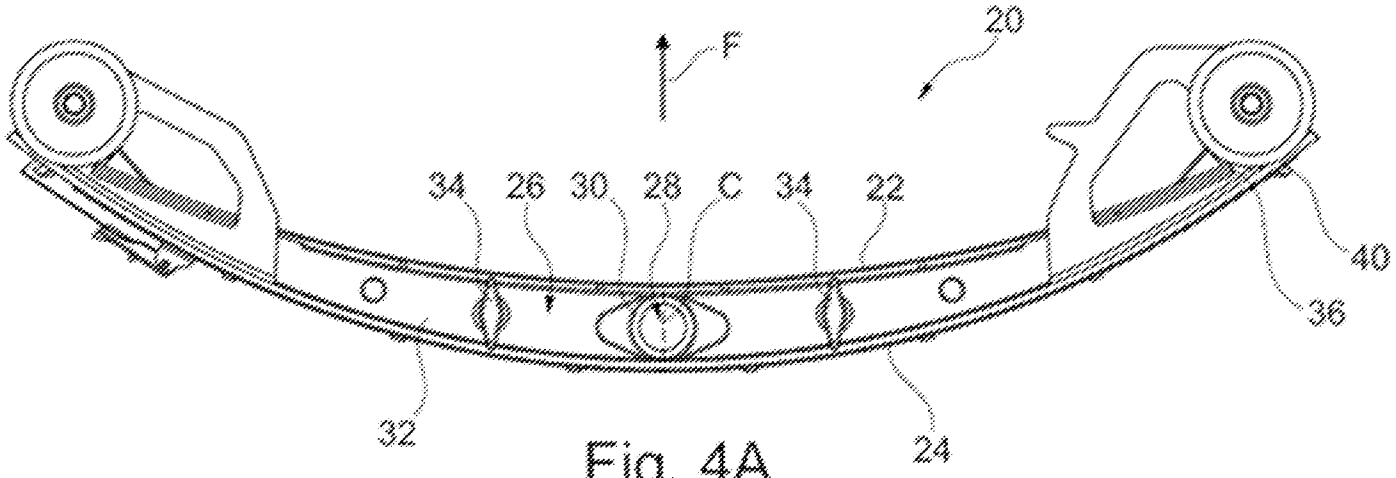
FIG. 4A is a top view of the squeegee assembly of FIG. 3A in accordance with at least one example of the present disclosure.
Figure 4B:
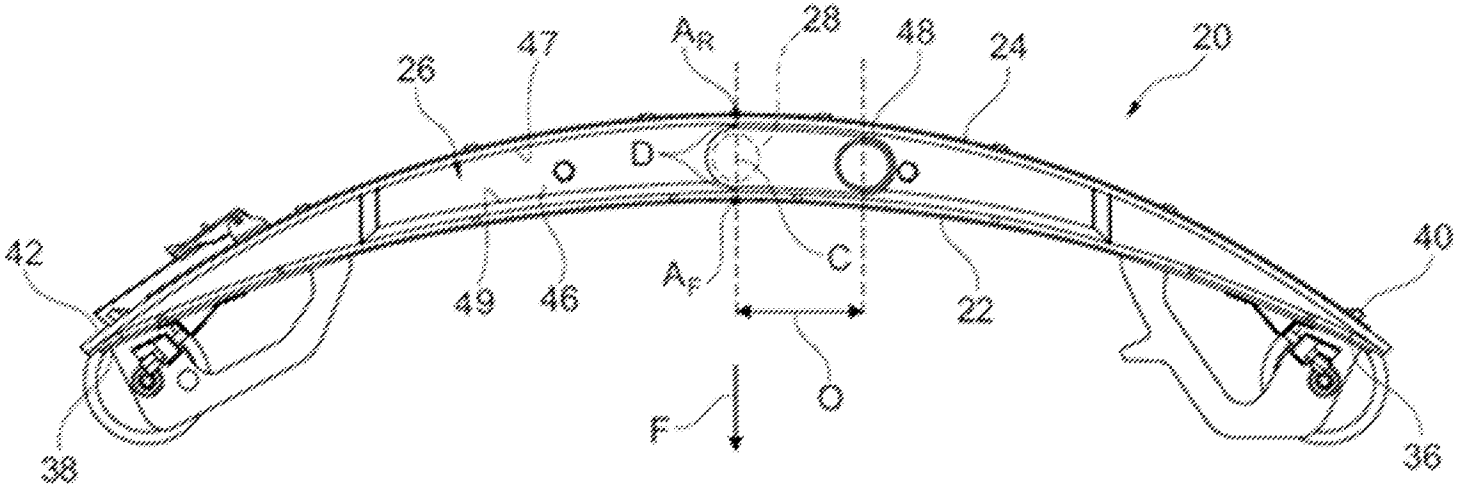
FIG. 4B is a bottom view of the squeegee assembly of FIG. 3A in accordance with at least one example of the present disclosure.

FIGS. 4A and 4B are top and bottom views, respectively, of the squeegee assembly 20 in accordance with at least one example of the present disclosure.

As illustrated in FIGS. 4A and 4B, the front flexible blade 22 can include a first end 36 and a second end 38, while the rear flexible blade 24 can include a first end 40 and a second end 42. As further illustrated in FIGS. 4A and 4B, the curvature of the front flexible blade 22 can define a front apex AF, and the curvature of the rear flexible blade 24 can define a rear apex AR. The front flexible blade 22 and rear flexible blade 24 can be mounted to the support 26 such that the front flexible blade 22 and rear flexible blade 24 are spaced by a maximum distance along a centerline C of the support 26 that extends through one or both of the front apex AF and the rear apex AR, and taper towards each other so that the first ends 36 and 40 and the second ends 38 and 42 are closely adjacent and/or tight against each other in the assembled position illustrated in FIGS. 4A and 4B. In an example, the centerline C of the support 26 can be parallel with a forward direction of travel F of the squeegee assembly 20. In an example, as shown in FIG. 4B, a maximum distance D can be defined between an inner surface 47 of the front flexible blade 22 and an inner surface 49 of the rear flexible blade 24 along the centerline C of the support 26.

In various examples, the front apex AF can be the rearmost point of the front flexible blade 22 or the centermost point between the first end 36 and the second end 38 of the front flexible blade 22. Similarly, in various examples, the rear apex AR can be the rearmost point of the rear flexible blade 24 or the centermost point between the first end 40 and the second end 42 of the rear flexible blade.

In an example, one or both of the front apex AF and the rear apex AR can be aligned with the centerline C of the support 26. In another example, one or both of the front apex AF and the rear apex AR can be offset from the centerline C of the support 26. In still other examples, one or both of the front flexible blade 22 and the rear flexible blade 24 can be configured such that they define more than one rearmost point, thereby defining multiple apexes between the first and second ends of the blade(s).

As further illustrated in FIG. 4A, the vacuum source port 28 can extend through the top side 32 of the support 26 such that the vacuum source port 28 is substantially aligned with the centerline C of the support 26. Thus, the vacuum source port 28 can be in fluid communication, either directly or indirectly, with a suction chamber formed between the front flexible blade 22, the rear flexible blade 24, the bottom side 46 (FIG. 4B) of the support 26, and the surface upon which the front flexible blade 22 and rear flexible blade 24 are in contact. In other examples, the vacuum source port 28 can be offset from the centerline C of the support 26 instead of substantially aligned with the centerline C of the support 26. In still other examples, the vacuum source port 28 can extend through a front side or a rear side of the support 26 instead of through the top side 32. As will be appreciated by one of ordinary skill in the art, the front and rear sides are the front and rear surfaces of the support 26 that extend between the top side 32 and the bottom side 46.

As further illustrated in FIG. 4B, the suction port 48 can extend through the bottom side 46 of the support 26 and can be offset from the centerline C of the support 26. With further reference to FIG. 4B, the offset from the centerline C of the support 26 can be generally identified as offset O. However, as will be discussed in further detail below, the offset O can be defined by an offset in the X-direction (see FIG. 5A, for example), an offset in the Y-direction, or an offset in both the X-direction and the Y-direction (see FIG. 5C, for example). Although the offset O is shown in FIG. 4B as oriented toward the first ends 36 and 40 of the front flexible blade 22 and rear flexible blade 24, respectively, the offset can alternatively be oriented toward the second ends 38 and 42 of the front flexible blade 22 and rear flexible blade 24, respectively, without departing from the spirit and scope of the present disclosure.

With further reference to FIGS. 4A and 4B, the vacuum source port 28 and the suction port 48 are shown as defining generally circular openings merely for purposes of example and not limitation. As such, the vacuum source port 28 and the suction port 48 can define openings having any suitable symmetrical or asymmetrical shape including, but not limited to, an oval, a rectangle, a square, a diamond, or any other polygonal, curved, or rounded shape. Furthermore, in an example, the vacuum source port 28 can be the same size and shape as the suction port 48. In another example, the vacuum source port 28 can be the same shape as the suction port 48 but sized smaller or larger than the suction port 48. In yet another example, the vacuum source port 28 can be shaped and sized different than the suction port 48.

FIGS. 5A-5E depict an asymmetrical squeegee in that the right end is farther forward (relative to the direction of travel) than the left end. The rearmost point of the rear blade is not equidistant from the two ends, and the line LL of the support through the rearmost point and parallel to the direction of travel does not intersect the center point of the arcs.

Figure 5A:
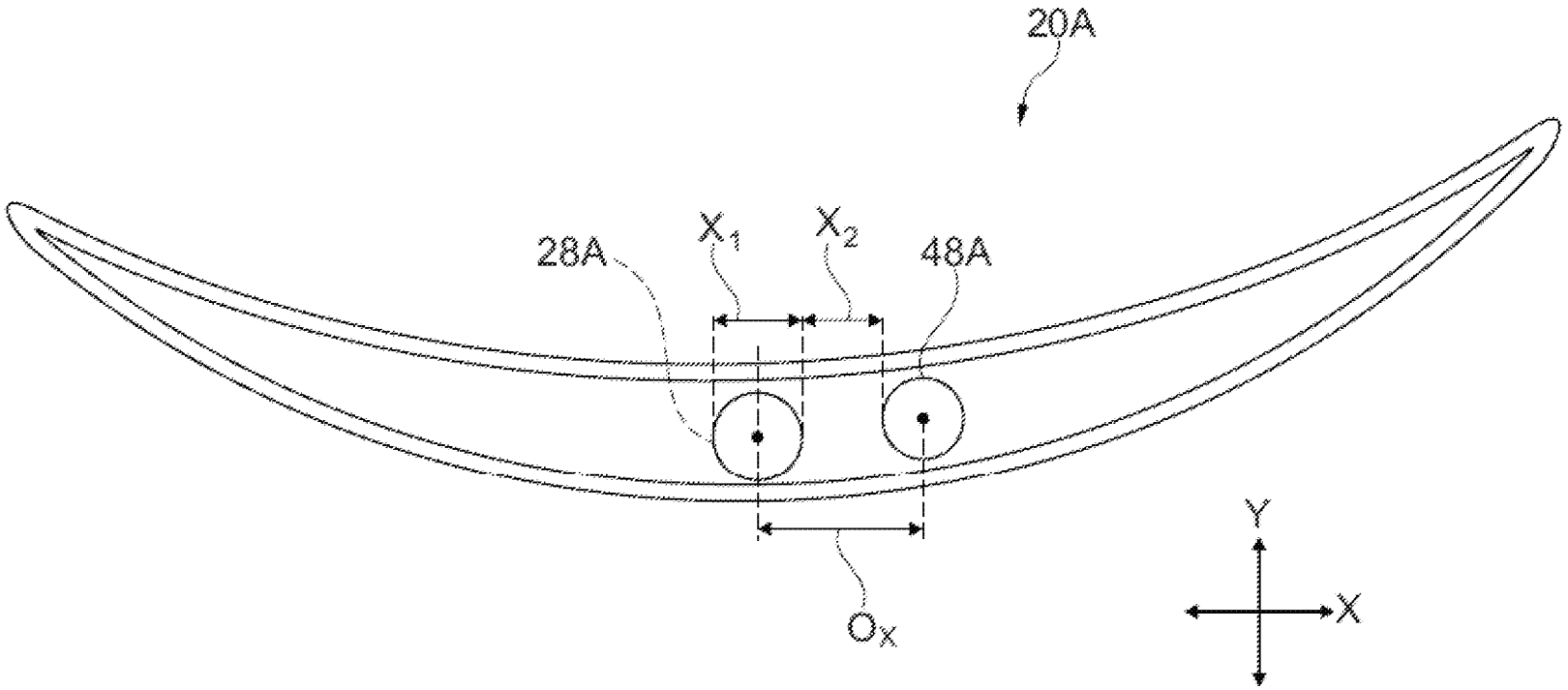
FIG. 5A is a diagrammatic illustration of a bottom side of a squeegee assembly having an offset suction port in accordance with at least one example of the present disclosure.

FIG. 5A is a diagrammatic illustration of the bottom side of a squeegee assembly 20A having an offset suction port 48A in accordance with at least one example of the present disclosure. As illustrated in FIG. 5A, the vacuum source port 28A can define a dimension XI in the X-direction, which in this example is the diameter of the circular opening. With further reference to FIG. 5A, the suction port 48A is shown offset from the vacuum source port 28A by an offset OX in the X-direction. Additionally, a spacing X2 is shown between an outermost edge of the vacuum source port 28A and an outermost edge of the suction port 48A. In an example, the spacing X2 can be substantially equal to the dimension XI such that the suction port 48A is spaced apart from the vacuum source port 28A by an amount equal to the diameter of the vacuum source port 28A. In other examples, the spacing X2 can be less than or greater than the dimension XI without departing from the intended scope of the present disclosure.

Figure 5C:
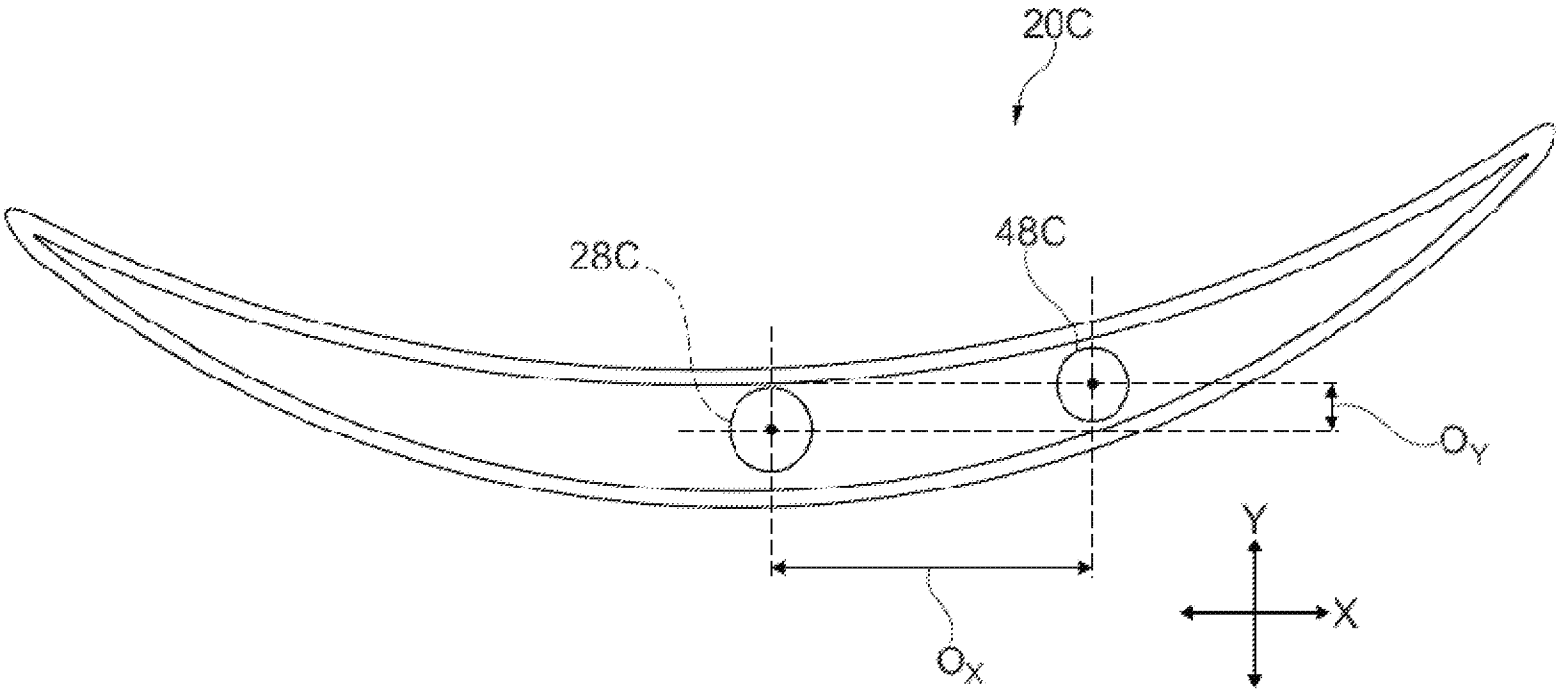
FIG. 5C is a diagrammatic illustration of another squeegee assembly having an offset suction port in accordance with at least one example of the present disclosure.

FIG. 5C is a diagrammatic illustration of the bottom side of a squeegee assembly 20C having an offset suction port 48C in accordance with at least one example of the present disclosure. In particular, the configuration shown in FIG. 5C is a combination of the configuration of FIG. 5A. As illustrated in FIG. 5C, the vacuum source port 28C is shown offset from the vacuum source port 28C by an offset OX in the X-direction and by an offset OY in the Y-direction. The offsets OX and OY can vary and are limited only by the spacing between the inner surface 47 of the front flexible blade 22 and the inner surface 49 of the rear flexible blade 24 (see FIG. 4B).

Figure 5D:
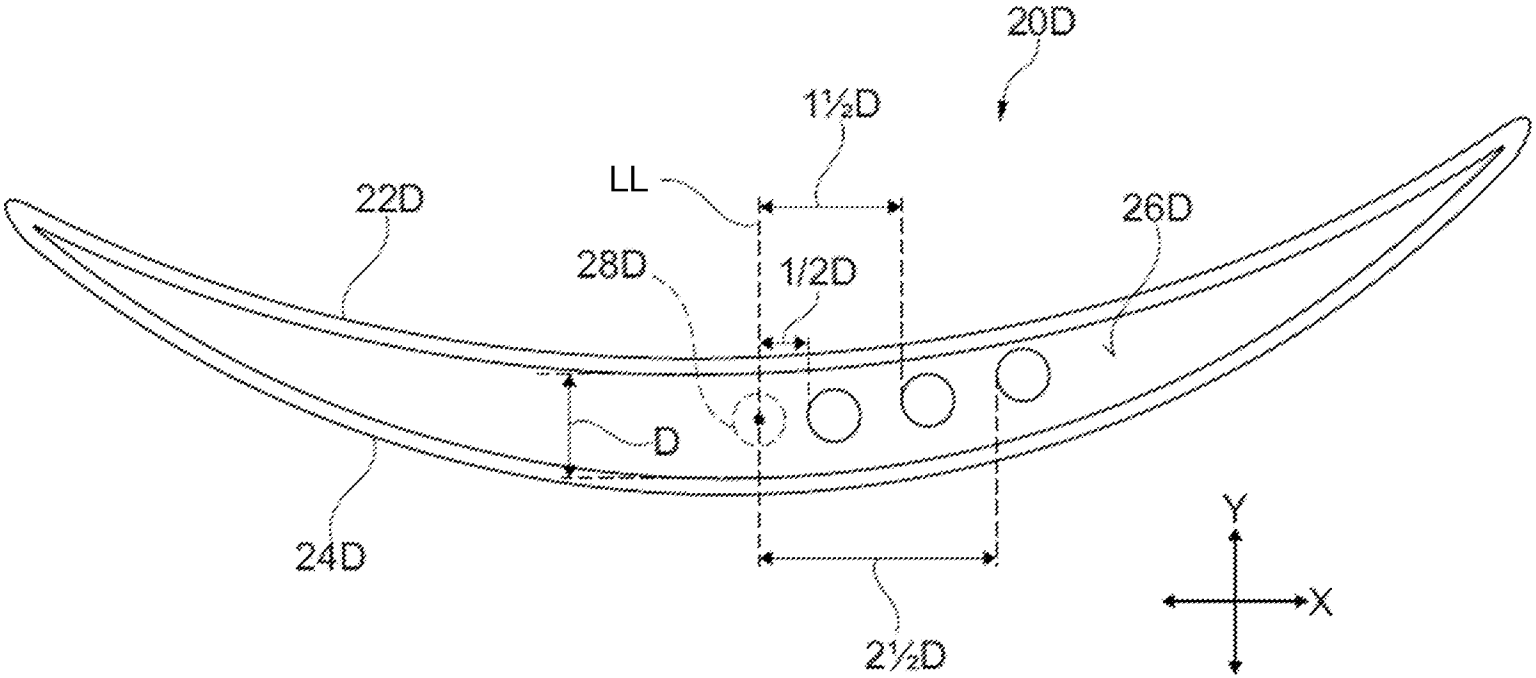
FIG. 5D is a diagrammatic illustration of another squeegee assembly having an offset suction port in accordance with at least one example of the present disclosure.

FIG. 5D is a diagrammatic illustration of the bottom side of a squeegee assembly 20D having an offset suction port 48D in accordance with at least one example of the present disclosure. As shown in FIG. 5D, an edge of the suction port 48D can be offset from the line LL of the support 26D by at least ½ the distance D between the front flexible blade 22 and rear flexible blade 24D along the line LL of the support. For example, FIG. 5D depicts the suction port 48D with a spacing of ½D in a solid line and spacings of 1½D and 2½D in broken lines. However, any spacing that is at least ½ the distance D between the front flexible blade 22D and rear flexible blade 24D along the line LL of the support is within the intended scope of the present disclosure.

Figure 5E:
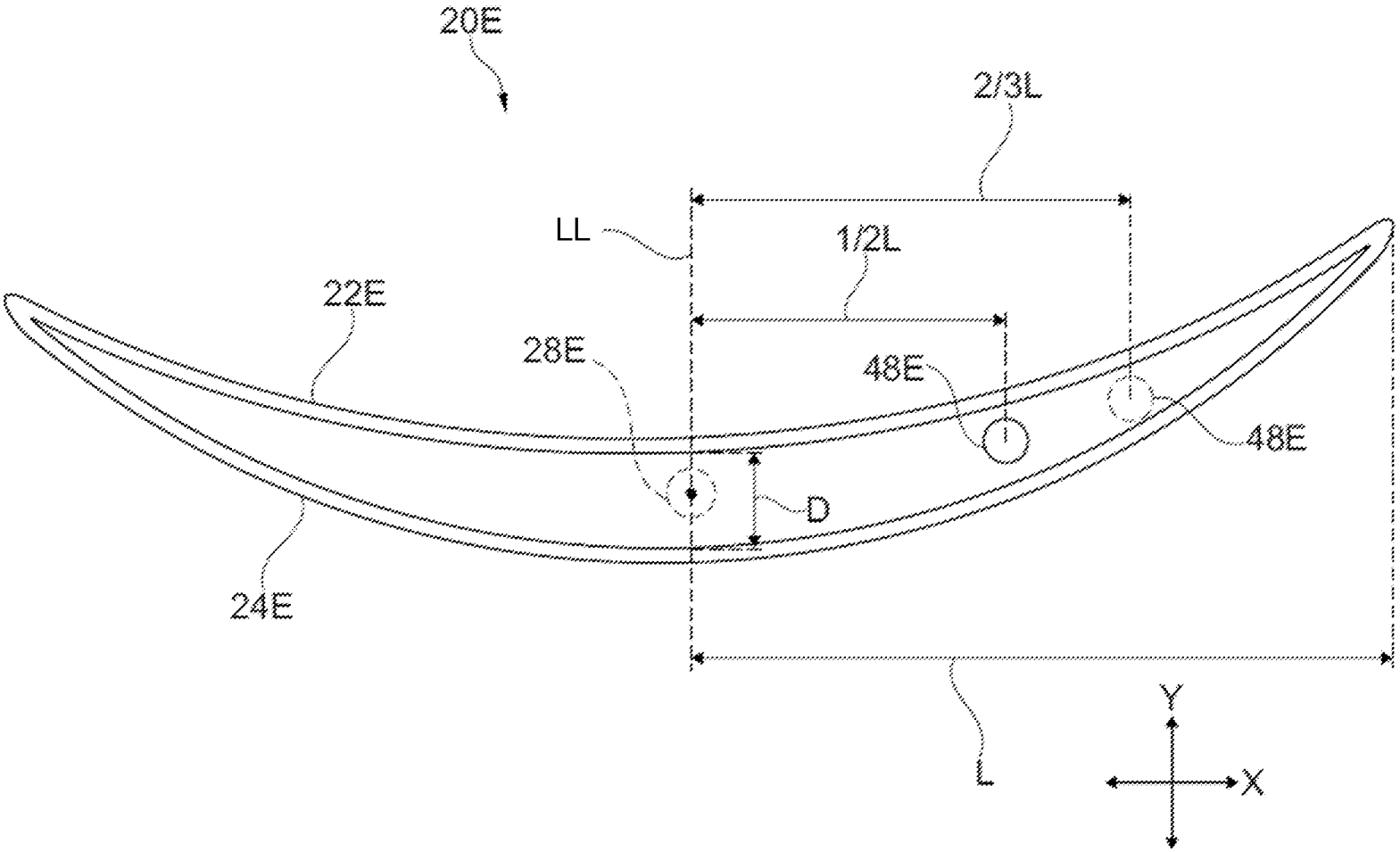
FIG. 5E is a diagrammatic illustration of another squeegee assembly having an offset suction port in accordance with at least one example of the present disclosure.

FIG. 5E is a diagrammatic illustration of the bottom side of a squeegee assembly 20E having an offset suction port 48E in accordance with at least one example of the present disclosure. As shown in FIG. 5E, a centerline CS of the suction port 48E can be offset from the line LL of the support 26E by between about ½ and about ⅔ of a length L from the line LL of the support to one of the ends of the rear flexible blade 24E. For example, FIG. 5E depicts the suction port 48E with a spacing of about ½L in a solid line and a spacing of about ⅔L in a broken line. Although FIG. 5E depicts the outer limits of the spacing in accordance with the present example, any spacing that is between about ½L and about ⅔L is within the intended scope of the present disclosure.

FIGS. 5A-5E represent only a subset of the possible offset configurations wherein the vacuum source port 28 is not aligned with the suction port 48. Numerous other configurations wherein the suction port 48 is offset from the line LL of the support 26 or the vacuum source port 28 either laterally (e.g. X-direction) or in a forward/aft direction (e.g. Y-direction) are contemplated and within the intended scope of the present disclosure. Furthermore, the suction port 48 is shown offset from the line LL of the support 26 in a direction opposite that of FIG. 4B merely for purposes of example and to make clear that offsets on either side of the line LL of the support 26 are within the intended scope of the present disclosure.

Figure 6A:
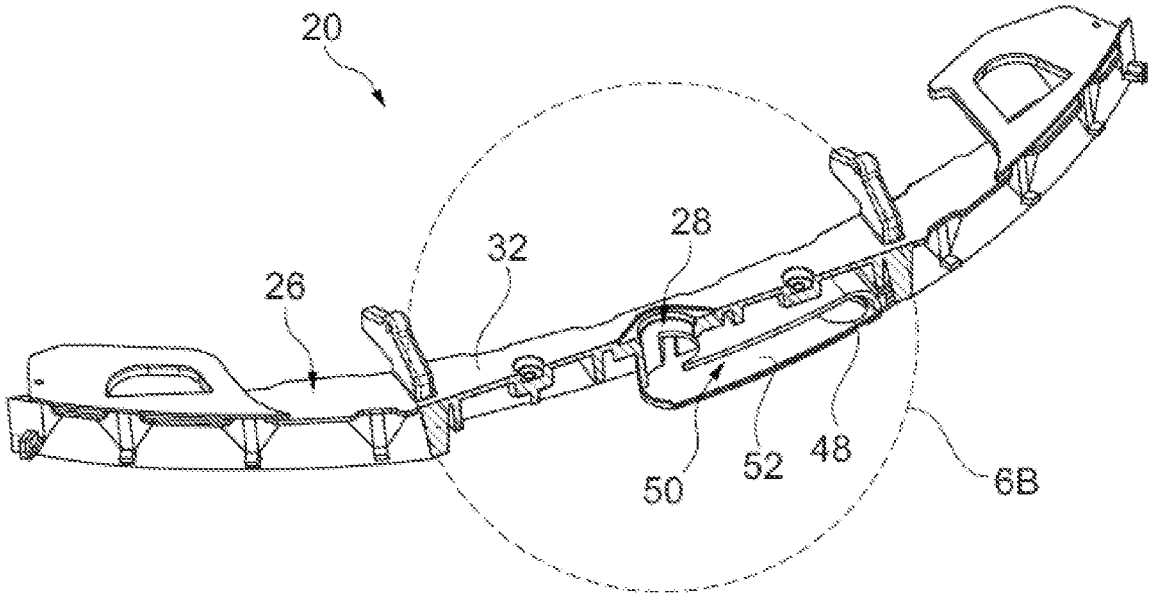
FIG. 6A is a rear perspective view of the squeegee assembly of FIG. 3A partially cut-away and with a rear flexible blade removed in accordance with at least one example of the present disclosure.
Figure 6B:
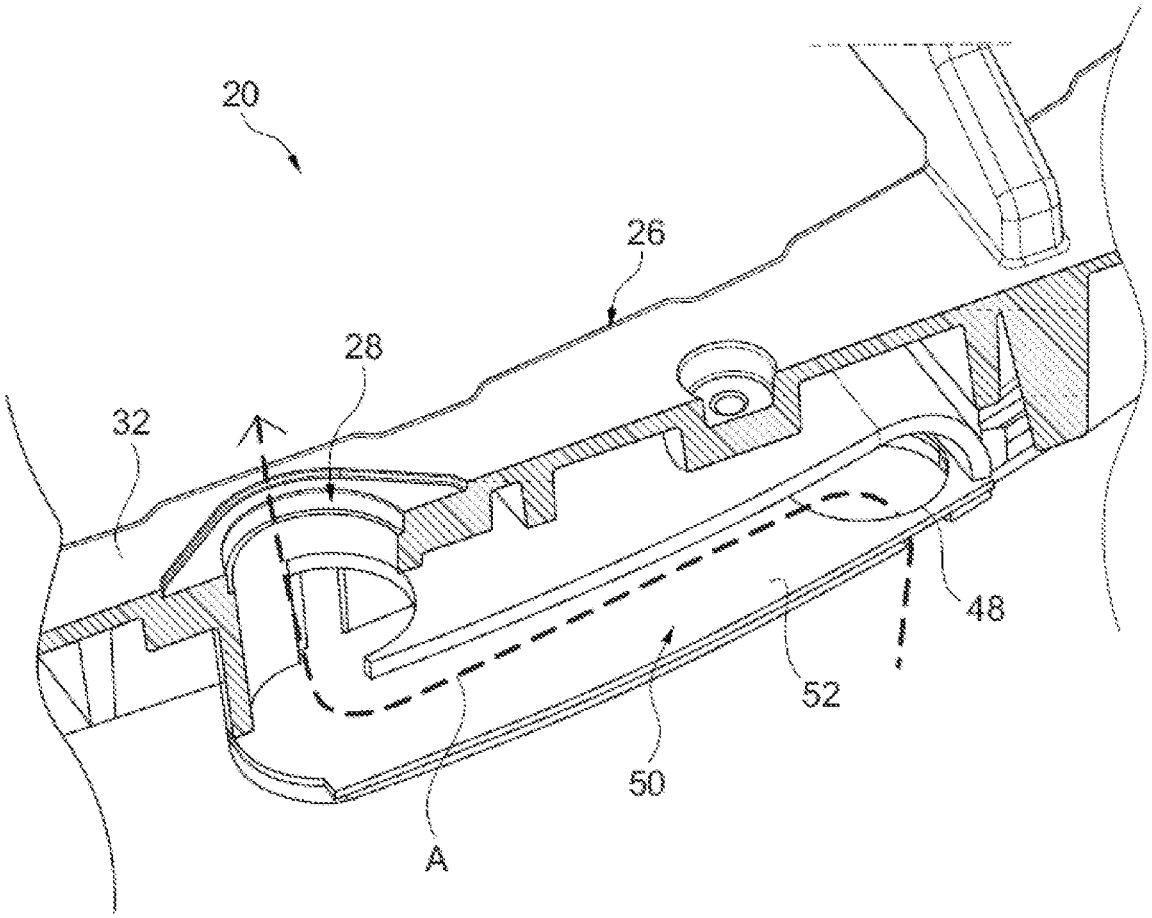
FIG. 6B is an enlarged view of the cut-away portion of the squeegee assembly of FIG. 6A in accordance with at least one example of the present disclosure.

FIG. 6A is a rear perspective view of the squeegee assembly 20 partially cut-away and with the rear flexible blade removed in accordance with at least one example of the present disclosure. FIG. 6B is an enlarged view of the cut-away portion of the squeegee assembly 20. With reference to FIGS. 6A and 6B, the rear flexible blade 24 (see FIG. 3B) has been removed from the support 26 and a portion of the support 26 has been partially resected in order to illustrate an airflow path A between the suction port 48 and the vacuum source port 28 in accordance with at least one example of the present disclosure.

As discussed above, when the vacuum source port 28 is operably coupled to a vacuum source a suction chamber can be formed between the front flexible blade 22, the rear flexible blade 24, the bottom side 46 of the support 26 (see FIG. 4B), and the surface upon which the front flexible blade 22 and rear flexible blade 24 are in contact. With further reference to FIGS. 6A and 6B, upon activation of the vacuum source, liquid and other debris that has been collected in the suction chamber between the front and rear flexible blades can be pulled into the airflow path A and be suctioned through the suction port 48, into an intermediate chamber 50, through the vacuum source port 28, and into a recovery tank (not shown).

The intermediate chamber 50 can be structured and configured to provide a path between the suction port 48 and the vacuum source port 28. However, there are additional benefits of the intermediate chamber 50 that can help address the issue of backflow liquid previously experienced with conventional squeegee assemblies. For example, when the vacuum source (e.g. vacuum pump) operably coupled to the vacuum source port 28 is disabled and the airflow path A generated by the vacuum source no longer exists, liquid that has collected on the inner surfaces of the vacuum source port 28 and the suction tube attached thereto will tend to flow back down through the vacuum source port 28 toward the floor surface being cleaned. However, instead of creating a small puddle on the floor surface beneath the squeegee assembly, this backflow liquid can be collected on a base surface 52 of the intermediate chamber 50 thereby creating a "water trap." As a result, backflow liquid can be substantially prevented from flowing back onto the floor surface. When the vacuum source operably coupled to the vacuum source port 28 is once again activated, the airflow path A can pick up the backflow liquid collected on the base surface 52 of the intermediate chamber 50.

The base surface 52 of the intermediate chamber can be structured and/or contoured in various manners to allow the backflow liquid to "pool" on the base surface 52 and avoid allowing the backflow liquid to drip back down to the floor surface through the suction port 48. Furthermore, in an example, the intermediate chamber 50 can be formed integral with the support 26 such that the walls of the support define the intermediate chamber. In other examples, the intermediate chamber 50 can be formed from one or more components that are separate from and attachable to the support 26 to create an enclosed intermediate chamber.

Figure 7A:
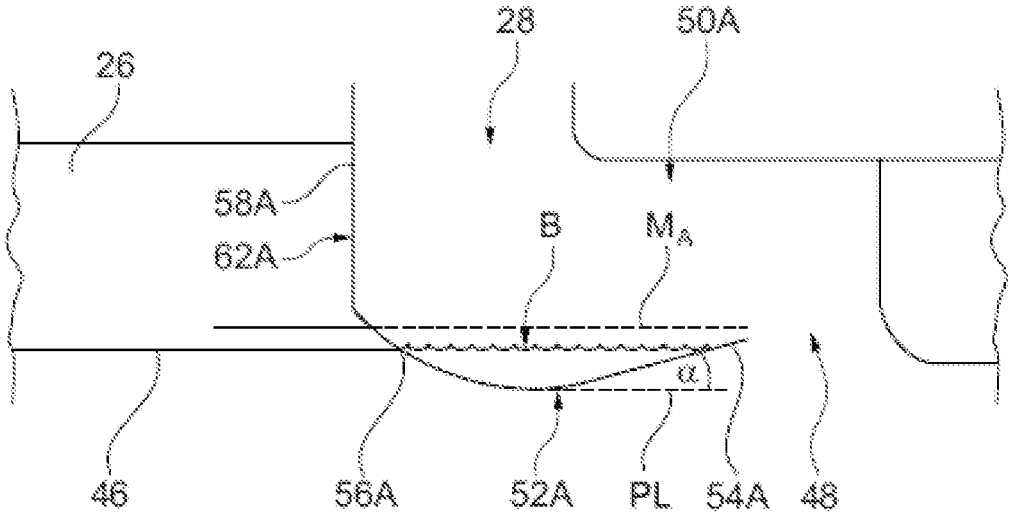
FIG. 7A is a diagrammatic illustration of an intermediate chamber design in accordance with at least one example of the present disclosure.
Figure 7B:
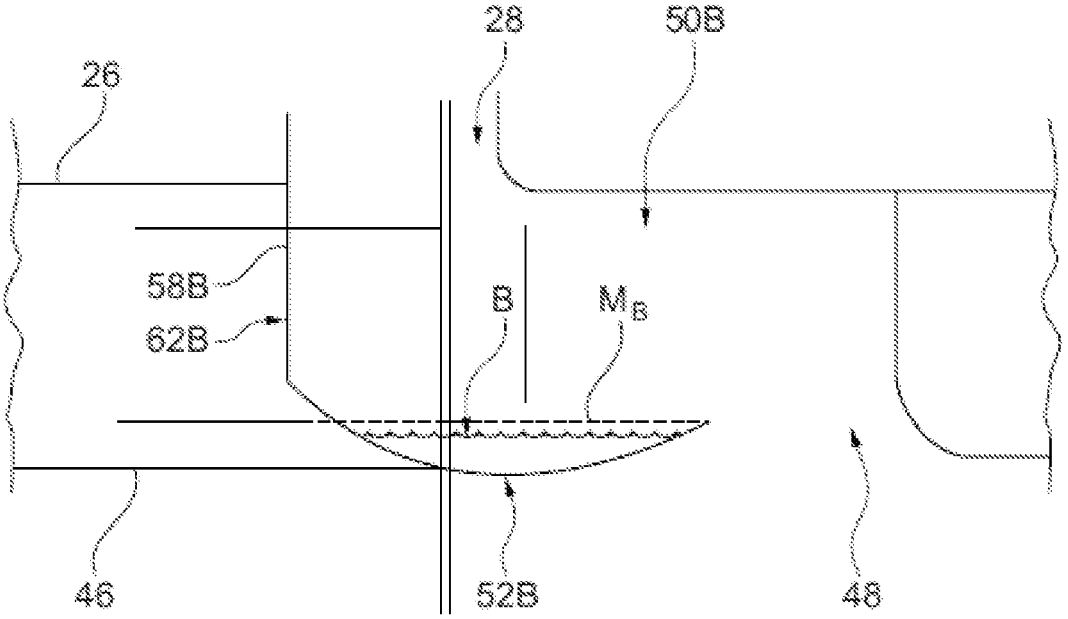
FIG. 7B is a diagrammatic illustration of another intermediate chamber design in accordance with at least one example of the present disclosure.

FIGS. 7A and 7B are diagrammatic illustrations of intermediate chamber designs in accordance with several examples of the present disclosure.

As shown in FIG. 7A, one example of an intermediate chamber 50A can include a base surface 52A having a planar portion 54A that is inclined at an angle $\alpha$ relative to a plane PL that is substantially parallel to the bottom side 46 of the support 26. In an example, the angle a can be less than about 45 degrees. In another example, the lowermost portion of the base surface 52A along the plane PL in FIG. 7A can instead coincide with the bottom side 46 of the support 26 such that the base surface 52A does not extend below the bottom side 46. As shown in FIG. 7A, in an example, the base surface 52A can further include a "dished" or continuously curved portion 56A adjacent to a vertical sidewall 58A of the intermediate chamber 50A that is straight or planar. The vertical sidewall 58A can intersect the curved portion 56A at a transition point 62A between the curved and planar surfaces. As shown in FIG. 7A, the water trap defined by the base surface 52A can collect the backflow liquid B up to a maximum level MA. In an example, the maximum level MA is below the transition point 62A such that the backflow liquid B cannot reach the vertical sidewall 58A as illustrated in FIG. 7A.

As shown in FIG. 7B, another example of an intermediate chamber 50B can include a "dished" or continuously curved base surface 52B adjacent to a vertical sidewall 58B of the intermediate chamber 50B that is straight or planar. The vertical sidewall 58B can intersect the curved base surface 52B at a transition point 62B between the curved and planar surfaces. In the example of FIG. 7B, the curved base surface 52B can define a dish-shaped water trap for collecting the backflow liquid B up to a maximum level MB. In an example, the maximum level MB is below the transition point 62B such that the backflow liquid B cannot reach the vertical sidewall 58B as illustrated in FIG. 7B.

Figure 8A:
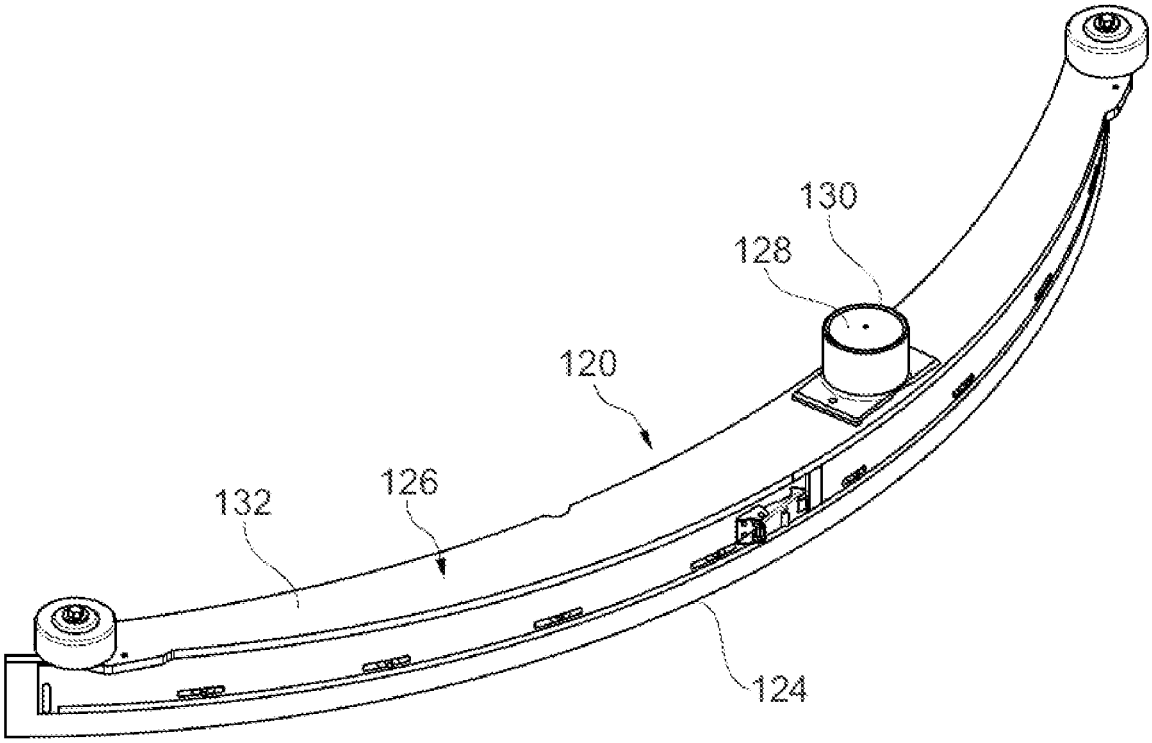
FIG. 8A is a rear perspective view of a squeegee assembly in accordance with at least one example of the present disclosure.
Figure 8B:
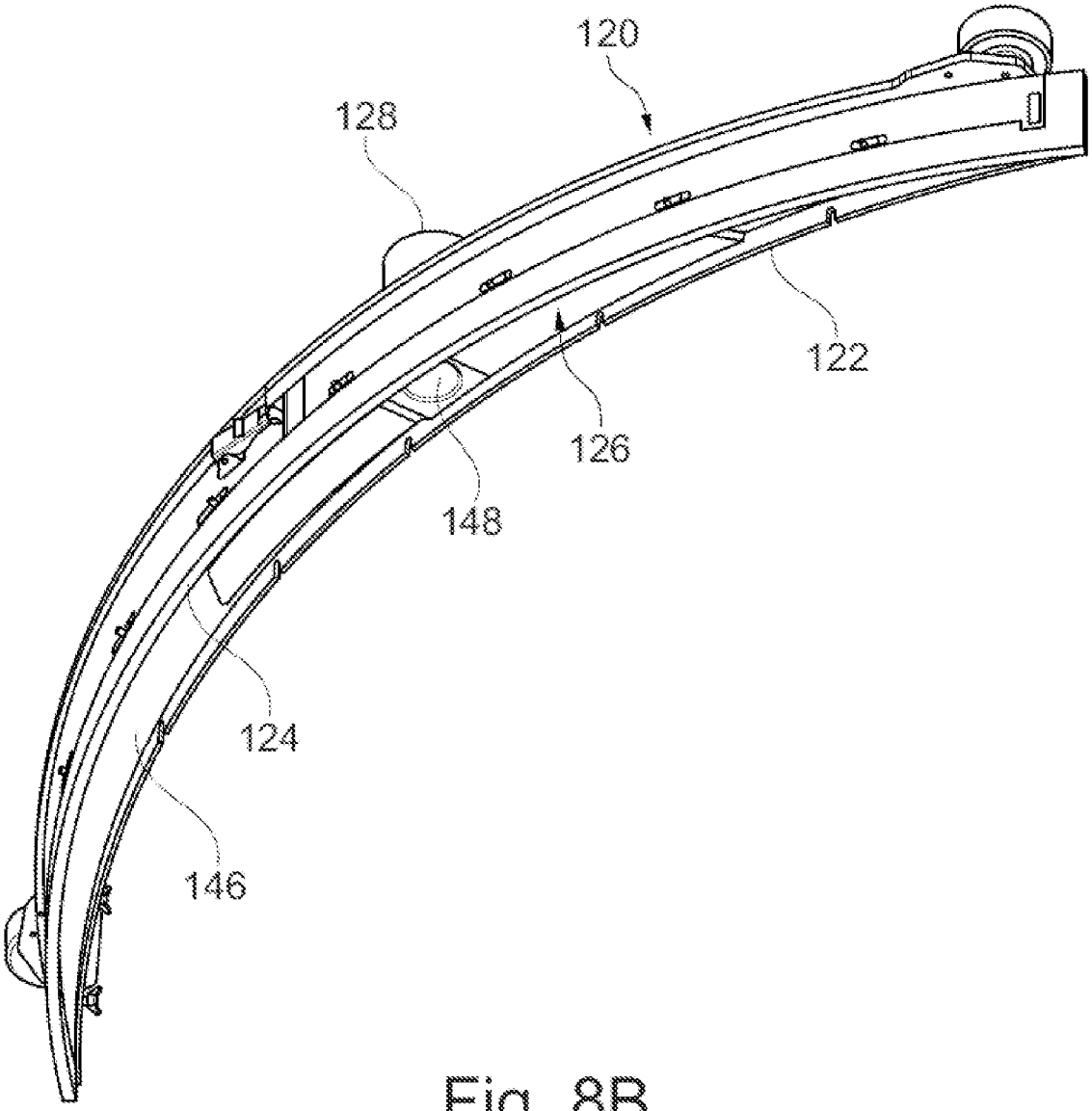
FIG. 8B is another rear perspective view of the squeegee assembly of FIG. 8A in accordance with at least one example of the present disclosure.

FIGS. 8A and 8B are rear perspective views of a squeegee assembly 120 in accordance with at least one example of the present disclosure. In many respects the squeegee assembly 120 is similar to the squeegee assembly 20 discussed above with reference to FIGS. 3A, 3B, 4A, and 4B, and can include a front flexible blade 122, a rear flexible blade 124, a support 126, and a vacuum source port 128 structured for connection to a vacuum source. The front flexible blade 22 and rear flexible blade 124 can extend from a bottom side of the support 126 and can be structured and designed to contact a floor surface. As illustrated in FIG. 8A, an upper end 130 of the vacuum source port 128 can extend from a top side 132 of the support 126. As illustrated in FIG. 8B, a suction port 148 can be provided on a bottom side 146 of the support 126. However, unlike the squeegee assembly 20, the vacuum source port 128 and the suction port 148 can both be offset from a centerline of the support 126. Additionally, the vacuum source port 128 and the suction port 148 can be aligned, such as vertically aligned. For example, a center of the vacuum source port 128 and a center of the suction port 148 can be laterally offset by the same distance and in the same direction relative to the centerline of the support 126. In the vertically aligned configuration, an airflow path can be generated from the suction port 148 directly into or toward the vacuum source port 128. As such, the squeegee assembly 120 can be designed without an intermediate chamber, such as the intermediate chamber 50 between the vacuum source port 28 and the laterally offset suction port 48 in the squeegee assembly 20 of FIGS. 6A and 6B.

Figure 9A:
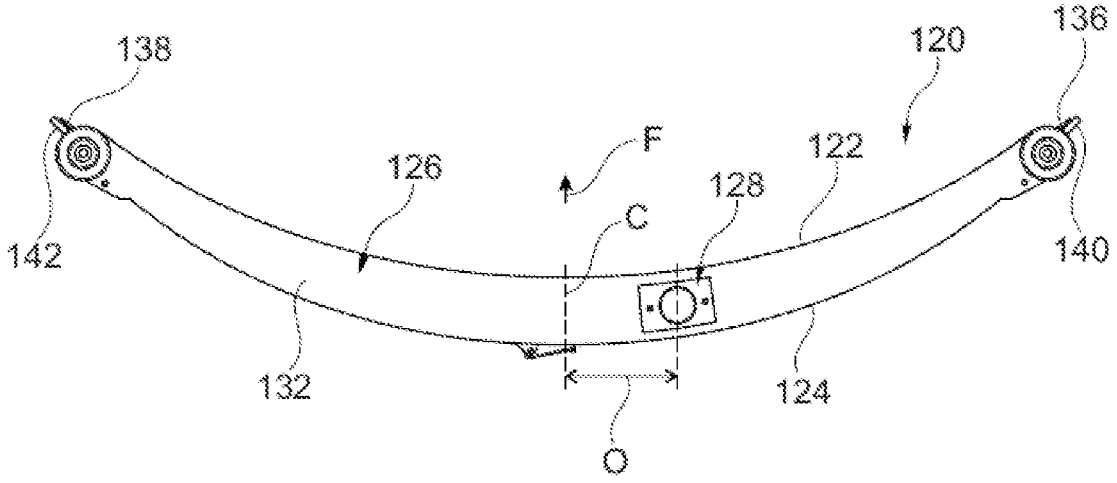
FIG. 9A is a top view of the squeegee assembly of FIG. 8A in accordance with at least one example of the present disclosure.
Figure 9B:
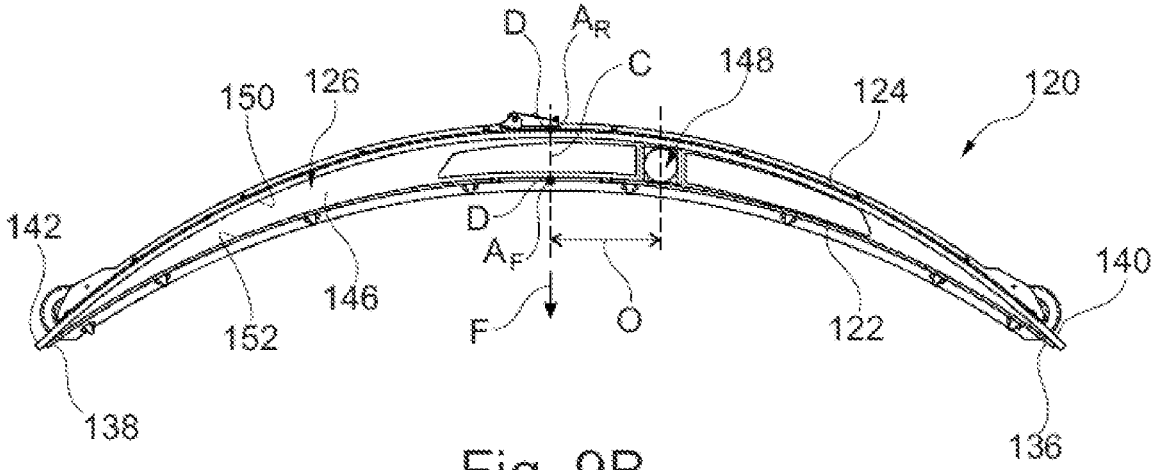
FIG. 9B is a bottom view of the squeegee assembly of FIG. 8A in accordance with at least one example of the present disclosure.

FIGS. 9A and 9B are top and bottom views, respectively, of the squeegee assembly 120 in accordance with at least one example of the present disclosure. As illustrated in FIGS. 9A and 9B, the front flexible blade 122 can include a first end 136 and a second end 138, while the rear flexible blade 124 can include a first end 140 and a second end 142. As further illustrated in FIGS. 4A and 4B, the curvature of the front flexible blade 122 can define a front apex AF, and the curvature of the rear flexible blade 124 can define a rear apex AR. The front flexible blade 122 and rear flexible blade 124 can be mounted to the support 126 such that the front flexible blade 122 and rear flexible blade 124 are spaced by a maximum distance along a centerline C of the support 126 that extends between the front apex AF and the rear apex AR, and taper towards each other so that the first ends 136 and 140 and the second ends 138 and 142 are closely adjacent and/or tight against each other in the assembled position illustrated in FIGS. 9A and 9B. As with the squeegee assembly 20, the centerline C of the support 126 can be parallel with a forward direction of travel F of the squeegee assembly 120, and a maximum distance D can be defined between an inner surface 150 of the front flexible blade 122 and an inner surface 152 of the rear flexible blade 124 along the centerline C.

As illustrated in FIG. 9A, the vacuum source port 128 can extend through the top side 132 of the support 126 and can be offset from the centerline C of the support 126. As further illustrated in FIG. 9B, the suction port 148 can extend through the bottom side 146 of the support 126 and can be offset from the centerline C of the support 126. With further reference to FIGS. 9A and 9B, the offset from the centerline C of the support 126 can be generally identified as offset O for both the vacuum source port 128 and the suction port 148. As such, the vacuum source port 128 and the suction port 148 can be described as vertically aligned due to the common offset O between the centerline C of the support 126 and both the vacuum source port 128 and the suction port 148. As will be appreciated by those skilled in the art, the offset O of the aligned vacuum source port 128 and suction port 148 can comprise any of the offsets previously described, such as those depicted in FIGS. 5A-5E. Additionally, although the offset O is shown in FIGS. 9A and 9B as oriented toward the first ends 136 and 140 of the front flexible blade 122 and rear flexible blade 124, respectively, the offset can alternatively be oriented toward the second ends 138 and 142 of the front flexible blade 122 and rear flexible blade 124, respectively, without departing from the spirit and scope of the present disclosure. Additionally, the size and shape of the vacuum source port 128 and the suction port 148 can include any of the sizes and shapes discussed above with reference to the vacuum source port 28 and the suction port 48.

To sum up, the disclosure provides a squeegee assembly includes a front blade, a rear blade, and a support for mounting the blades. The front blade includes an outer surface, an inner surface, and a floor engaging edge. The rear blade includes an outer surface, an inner surface facing the inner surface of the front blade, and a wiping edge. The support includes a vacuum source port and a suction port. The rear blade has a curvature between opposing first and second ends of the rear blade that defines at least one rearmost point. At least the suction port is offset from a line of the support that extends through the at least one rearmost point parallel to a forward direction of travel of the squeegee assembly.

The above Detailed Description includes references to the accompanying drawings, which form a part of the detailed description. The drawings show, by way of illustration, specific embodiments in which the disclosure can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment.

I claim:

1. A squeegee assembly for wiping a surface to be cleaned comprising:

a front blade including an outer surface, an inner surface, and a floor engaging edge;

a rear blade including an outer surface, an inner surface facing the inner surface of the front blade, and a wiping edge; and a support upon which the front blade and rear blade are mounted, the support including a vacuum source port and a suction port;

wherein the rear blade has a curvature between opposing first and second ends of the rear blade, the curvature of the rear blade defining at least one rearmost point; and wherein at least the suction port is offset from a first line of the support that extends through the at least one rearmost point of the rear blade parallel to a forward direction of travel of the squeegee assembly, such that the first line of support does not extend through the suction port.

2. The squeegee assembly of claim 1, wherein the front blade and rear blade are spaced apart by a maximum distance along the first line of the support.

3. The squeegee assembly of claim 2, wherein a center of the vacuum source port is vertically aligned with a center of the suction port.

4. The squeegee assembly of claim 2, wherein an outer edge of the suction port is offset from the first line of the support by a distance equal to or greater than one-half of the maximum distance between the front blade and rear blade.

5. The squeegee assembly of claim 1, wherein a center of the suction port is offset from the first line of the support by a distance equal to or greater than one-half of a length defined between the first line of the support and the first end of the rear blade.

6. The squeegee assembly of claim 1, further comprising:

wherein the suction port is offset from the vacuum source port, the suction port is located on a bottom surface of the support;

a suction chamber is formed between the front blade, the rear blade, and the bottom surface of the support; and an intermediate chamber formed between the suction port and the vacuum source port.

7. The squeegee assembly of claim 6, wherein the intermediate chamber is formed above the suction chamber.

8. The squeegee assembly of claim 7, wherein the front blade and rear blades are spaced apart by a maximum distance along the line of the support that extends through the at least one rearmost point of the rear blade parallel to the forward direction of travel of the squeegee assembly, wherein a center of the vacuum source port is disposed along the first line of the support, and wherein a center of the suction port is disposed along the first line of the support and is offset from the center of the vacuum source port in the forward direction of travel of the squeegee assembly.

9. The squeegee assembly of claim 7, wherein the front blade and rear blade are spaced apart by a maximum distance along the first line of the support that extends through the at least one rearmost point of the rear blade parallel to the forward direction of travel of the squeegee assembly, wherein a center of the vacuum source port is disposed along the line-of the support, and wherein a center of the suction port is offset from the first line of the support-in a lateral direction.

10. The squeegee assembly of claim 6, wherein the vacuum source port is structured to be coupled to a vacuum source such that, in use, an airflow path can be generated from the suction chamber, through the intermediate chamber, and toward the vacuum source port.

11. The squeegee assembly of claim 10, wherein an outer edge of the suction port is offset from the first line of the support by a distance equal to or greater than one-half of the maximum distance between the front blade and rear blade.

12. The squeegee assembly of claim 11, wherein the suction port is laterally offset from the vacuum source port by an offset distance, wherein the offset distance is equal to or greater than a diameter of the vacuum source port.

13. The squeegee assembly of claim 11, further comprising an intermediate chamber defined between the suction port and the vacuum source port includes a contoured base surface spaced vertically below the vacuum source port, the contoured base surface forming a water trap configured to collect backflow liquid from the vacuum source port, wherein the intermediate chamber includes a planar sidewall, and wherein the contoured base surface is defined by at least one curved portion spaced vertically below the planar sidewall.

14. The squeegee assembly of claim 11, wherein the center of the vacuum source port is disposed along a second line of the support that extends between a front apex of the front blade and a rear apex of the rear blade.

15. The squeegee assembly of claim 10, wherein a center of the suction port is offset from the first line of the support by a distance equal to or greater than one-half of a length defined between the first line of the support and the first end of the rear blade.

16. The squeegee assembly of claim 1, wherein the center of the suction port is further offset from the center of a vacuum source port in the forward direction of travel of the squeegee assembly.

17. The squeegee assembly of claim 1, wherein a center of the suction port is laterally offset from a center of the vacuum source port.

18. The squeegee assembly of claim 1, wherein the first line of the support that extends through the at least one rearmost point parallel to a forward direction of travel of the squeegee assembly is a centerline of the support.

* * * * *